US010618288B2

(12) United States Patent
Ender et al.

(10) Patent No.: US 10,618,288 B2
(45) Date of Patent: Apr. 14, 2020

(54) SHROUD FOR A PRINTHEAD ASSEMBLY

(71) Applicant: Hewlett-Packard Development Company, L.P., Houston, TX (US)

(72) Inventors: Ronald J. Ender, Corvallis, OR (US); Daniel D. Dowell, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/961,057

(22) Filed: Apr. 24, 2018

(65) Prior Publication Data

US 2018/0236772 A1 Aug. 23, 2018

Related U.S. Application Data

(63) Continuation of application No. 15/311,902, filed as application No. PCT/US2014/040330 on May 30, 2014, now Pat. No. 9,975,339.

(51) Int. Cl.

| | |
|---|---|
| ***B41J 2/16*** | (2006.01) |
| ***B41J 2/165*** | (2006.01) |
| ***B41J 2/145*** | (2006.01) |
| ***B41J 2/14*** | (2006.01) |
| ***B41J 2/155*** | (2006.01) |
| ***B41J 11/00*** | (2006.01) |

(52) U.S. Cl.

CPC ..... *B41J 2/16505* (2013.01); *B41J 2/145* (2013.01); *B41J 2/1433* (2013.01); *B41J 2/155* (2013.01); *B41J 11/005* (2013.01); *B41J 2002/16502* (2013.01); *B41J 2202/19* (2013.01); *B41J 2202/20* (2013.01)

(58) Field of Classification Search

None

See application file for complete search history.

(56) References Cited

U.S. PATENT DOCUMENTS

| | | | |
|---|---|---|---|
| 5,734,394 | A | 3/1998 | Hackelman |
| 6,390,593 | B1 | 5/2002 | Deroos et al. |
| 6,641,253 | B2 | 11/2003 | Silverbrook et al. |
| 6,722,756 | B2 | 4/2004 | Choy et al. |
| 7,188,925 | B2 | 3/2007 | Wood et al. |
| 7,686,418 | B2 | 3/2010 | Ha |
| 7,699,437 | B2 | 4/2010 | Choi et al. |
| 8,002,392 | B2 | 8/2011 | Lee et al. |

(Continued)

FOREIGN PATENT DOCUMENTS

| | | |
|---|---|---|
| CN | 1489523 | 4/2004 |
| CN | 1974217 | 6/2007 |

(Continued)

*Primary Examiner* — Erica S Lin

(74) *Attorney, Agent, or Firm* — Dierker & Kavanaugh PC

(57) ABSTRACT

In one example, a shroud to protect a group of printheads in a printhead assembly includes a body having a first notched end where an upstream part of the body extends past a downstream part of the body and a second notched end opposite the first end where a downstream part of the body extends past an upstream part of the body. A first group of openings in the body is aligned across the upstream part of the body and a second group of openings in the body is aligned across the downstream part of the body. Each opening is to surround an exposed part of a printhead when the shroud is installed on the printhead assembly.

13 Claims, 9 Drawing Sheets

(56) References Cited

U.S. PATENT DOCUMENTS

| | | | | |
|---|---|---|---|---|
| 8,529,020 | B2 | 9/2013 | Goto | |
| 8,573,739 | B2 | 11/2013 | Choy et al. | |
| 8,702,200 | B2 | 4/2014 | Choy | |
| 2002/0134305 | A1 | 9/2002 | Miki et al. | |
| 2004/0095419 | A1 | 5/2004 | Silverbrook | |
| 2005/0200669 | A1 | 9/2005 | Timm et al. | |
| 2007/0126778 | A1 | 6/2007 | Ha | |
| 2008/0018679 | A1 | 1/2008 | Kojima | |
| 2008/0079770 | A1 | 4/2008 | Sloan et al. | |
| 2010/0053265 | A1* | 3/2010 | Kim | B41J 2/14024 347/40 |
| 2010/0079542 | A1 | 4/2010 | Ciminelli et al. | |
| 2011/0115848 | A1 | 5/2011 | Ito | |
| 2011/0279613 | A1* | 11/2011 | Mandel | B41J 11/005 347/104 |

FOREIGN PATENT DOCUMENTS

| | | |
|---|---|---|
| JP | H05338160 | 12/1993 |
| JP | 2008055839 | 3/2008 |
| JP | 2009012412 | 1/2009 |
| WO | WO-2014003719 | 1/2014 |
| WO | WO-2014003727 A1 | 1/2014 |

* cited by examiner

SHROUD FOR A PRINTHEAD ASSEMBLY

CROSS REFERENCE TO RELATED APPLICATIONS

This is a continuation of U.S. patent application Ser. No. 15/311,902 filed Nov. 17, 2016 which is itself a Section 371 national entry of international patent application no. PCT/US2014/040330 filed May 30, 2014, each of which is incorporated herein by reference in its entirety.

BACKGROUND

In some inkjet printers, a stationary media wide printhead assembly, commonly called a print bar, is used to print on paper or other print media moved past the print bar.

DRAWINGS

The same part numbers designate the same or similar parts throughout the figures. The figures are not necessarily to scale. The size of some parts may be exaggerated for clarity.

DESCRIPTION

Figure 1:
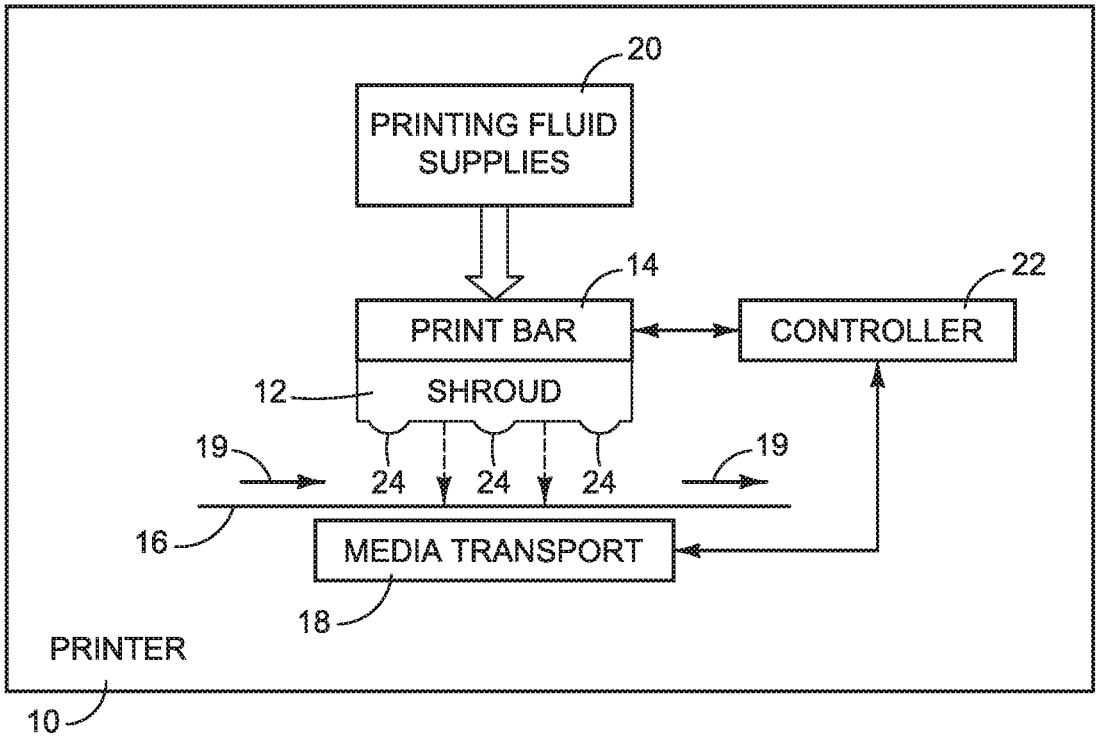
FIG. 1 is a block diagram illustrating an inkjet printer in which examples of a new printhead assembly shroud may be implemented.

A stationary print bar in an inkjet printer is susceptible to print quality defects and damage from paper or other print media contacting into the printheads. Fragile parts in the print bar can also be damaged during handling, for example during shipping and installation. A protective shroud is sometimes used to protect the printheads and other fragile components in the print bar. A new modular print bar with "stackable" (horizontally end-to-end), interchangeable printhead assembly modules is disclosed in international patent application PCT/US14/40264 titled Printhead Assembly Module and filed May 30, 2014. The new modular print bar has been developed for use in large format inkjet printers to expand the range of media sizes that may be printed with a stationary media wide print bar. The use of interchangeable printhead assembly modules, however, may increase handling and the corresponding risk of damage. Also, the arrangement of the printheads on the new modules broadens the area covered by the shroud compared to existing printhead assemblies. Accordingly, a new, more robust shroud has been developed to better protect the printheads and other fragile parts during handling and printing.

In one example, a printhead assembly shroud includes openings through which the printheads are exposed and a ridge or other elongated protrusion along an exterior surface next to the openings. The elongated protrusion helps block the print media and other intrusions from contacting the exposed part of the printheads as well as strengthens the body of the shroud covering the periphery of the printheads and other parts of the printhead assembly.

In one example for an interchangeable printhead module such as that disclosed in application PCT/US14/40264, the shroud includes a first group of openings aligned across the body shroud and a second group of openings aligned across the body behind and parallel to the first group of openings. Each opening surrounds an exposed part of a printhead. A first ridge protrudes from and extends across the body in front of the first group of openings and a second ridge protrudes from and extends across the body in front of the second group of openings. The first and second groups of openings are symmetrical with respect to one another about an axis of symmetry and the first and second ridges are symmetrical with respect to one another about the axis such that the shroud is reversible between two orientations to protect the printheads with the first ridge in front of the openings or with the second ridge in front of the openings.

Examples of the new shroud are described with reference to printhead assembly modules that may be used in a stationary media wide print bar. However, examples of the new shroud are not limited to media wide print bars, printhead assembly modules, or even inkjet printers, but might also be implemented with other print mechanisms and in other inkjet type dispensers. The examples shown and described, therefore, illustrate but do not limit the disclosure, which is defined in the Claims following this Description.

FIG. 1 is a block diagram illustrating an inkjet printer 10 in which examples of a new printhead assembly shroud 12 may be implemented. Referring to FIG. 1, printer 10 includes a print bar 14 with an arrangement of printheads for dispensing ink or other printing fluid on to a sheet or continuous web of paper or other print media 16. Printer 10 also includes a print media transport mechanism 18 for moving media 16 past print bar 14, as indicated by direction arrows 19, printing fluid supplies 20 for supplying printing fluid to print bar 14, and a printer controller 22. Controller 22 represents generally the programming, processor(s) and associated memories, and the electronic circuitry and components needed to control the operative elements of printer 10. As described in detail below with reference to the example shown in FIGS. 2-9, shroud 12 includes ridges or other topography 24 to strengthen shroud 12 and to help block media 16 and other intrusions from contacting the printheads and other parts of print bar 14.

Figure 2:
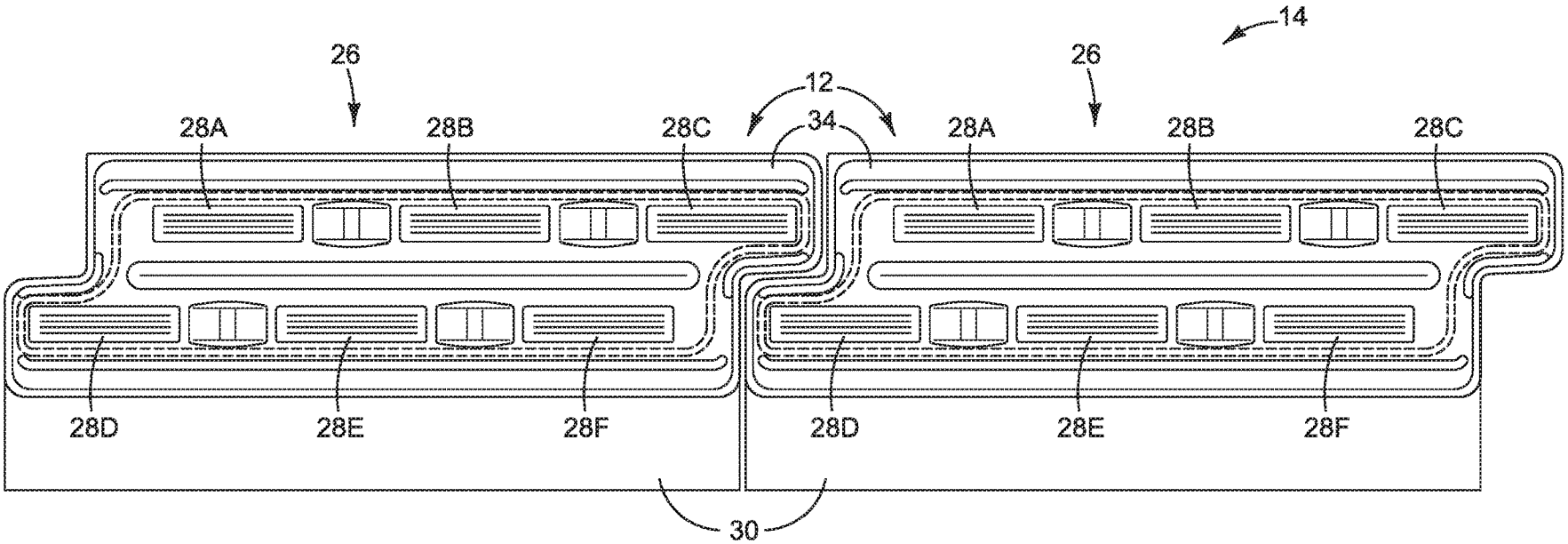
FIG. 2 illustrates a modular print bar implementing one example of a protective shroud such as might be used in the printer of FIG. 1.
Figure 3:
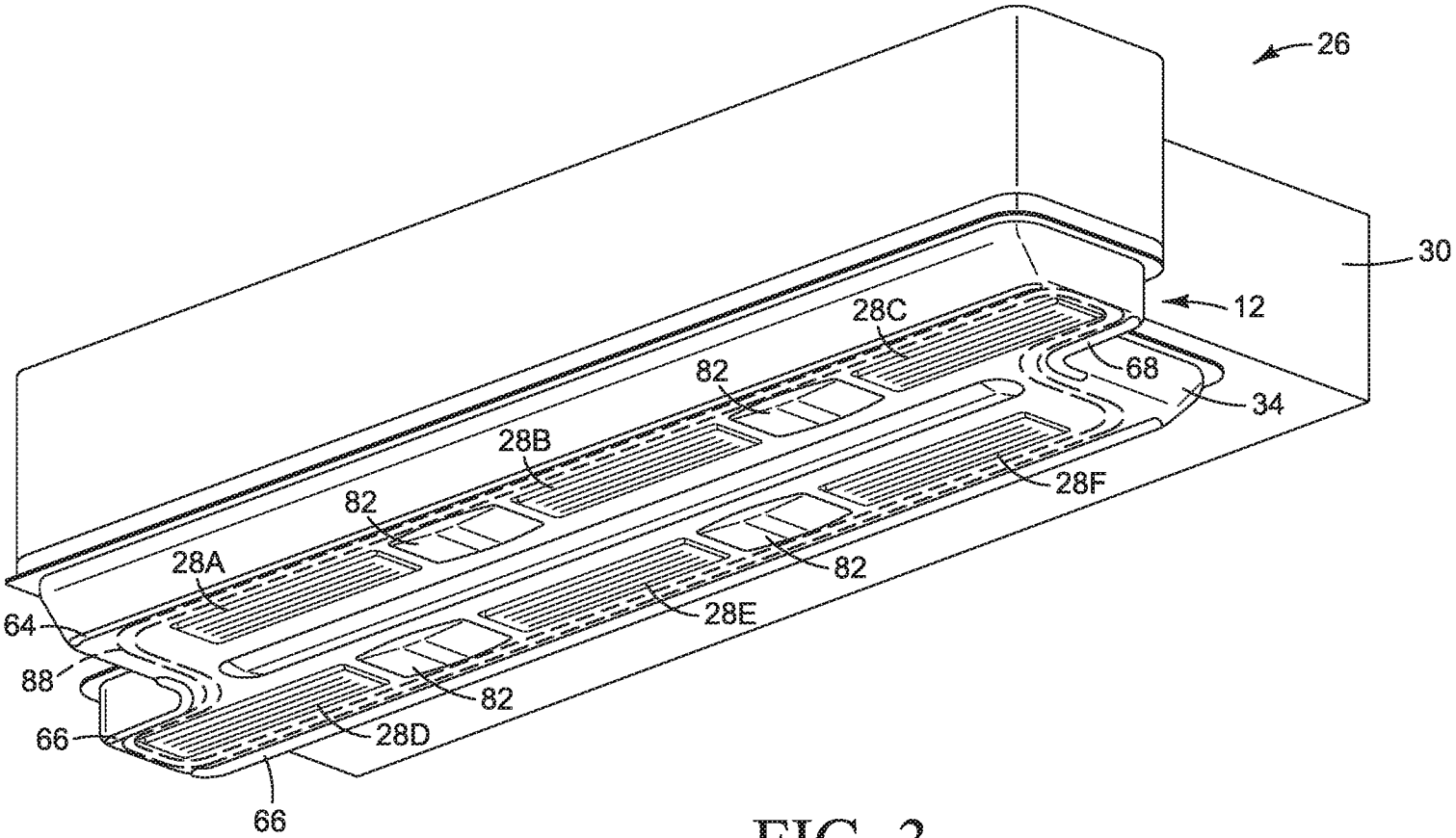
FIG. 3 is a perspective view of one of the printhead assembly modules in the print bar shown in FIG. 2.
Figure 4:
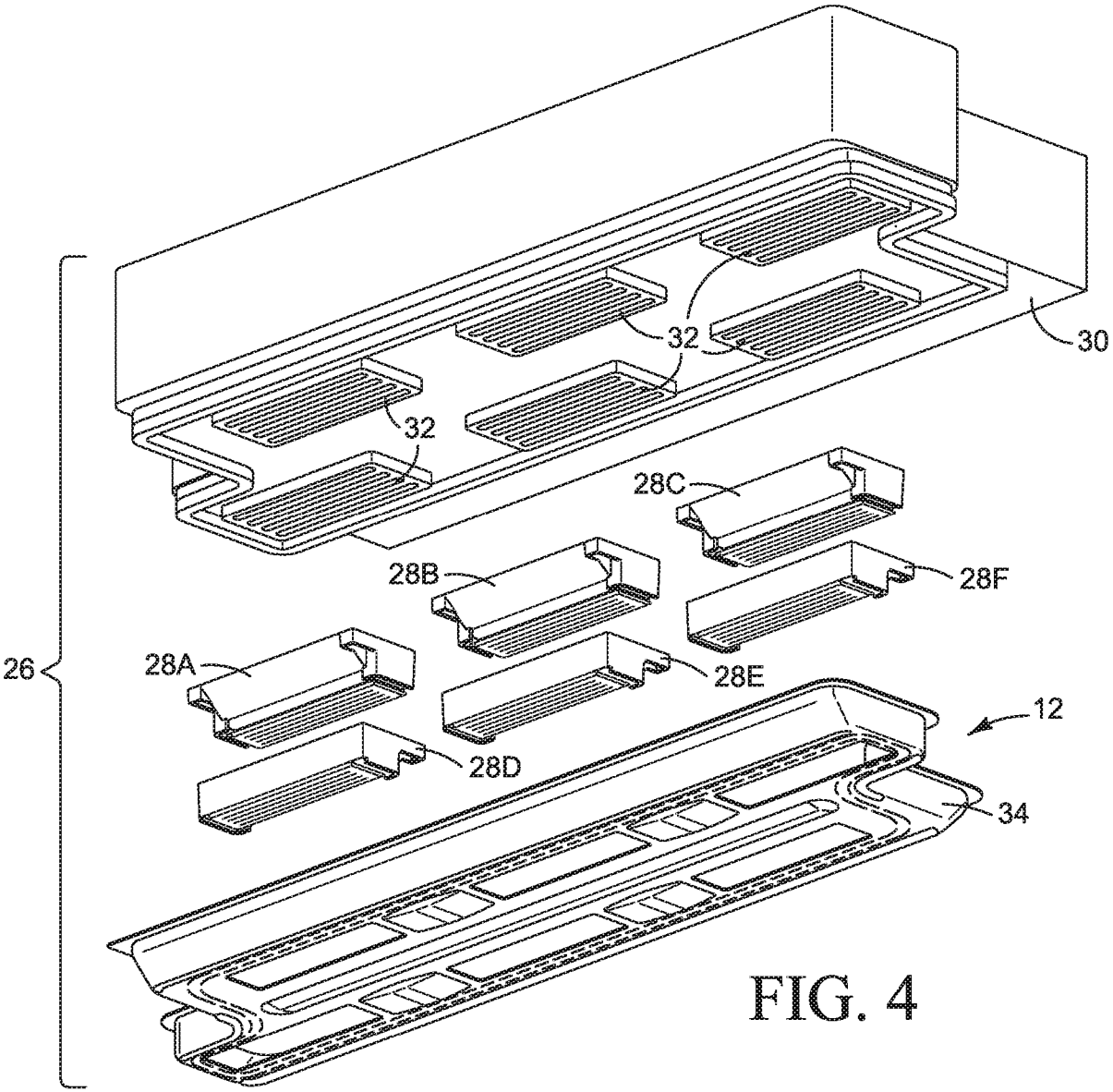
FIG. 4 is an exploded view of the printhead assembly module shown in FIG. 3.

FIG. 2 illustrates a modular print bar 14 implementing one example of a protective shroud 12 such as might be used in a printer 10 shown in FIG. 1. FIG. 3 is a perspective view of one of the printhead assembly modules 26 in print bar 14 shown in FIG. 2. FIG. 4 is an exploded view of printhead assembly module 26. Referring to FIGS. 2-4, print bar 14 includes identical printhead assembly modules 26 arranged end-to-end so that a protruding end of one module 26 overlaps a protruding end of the adjacent module. Thus, multiple interchangeable modules 26 are "stacked" end-to-end to form print bar 14.

Each module 26 includes printheads 28A-28F mounted to a chassis 30 and surrounded by shroud 12. In addition to supporting printheads 28A-28F and shroud 12, chassis 30 may provide the structural support and reference surfaces for accurately mounting print bar 14 in a printer. Chassis 30 usually will also house a part of the flow path for supplying printing fluid to each printhead 28A-28F including, for example, a series of channels 32 visible in FIG. 4. Although two modules 26 each with six printheads 28A-28F in a staggered arrangement are shown, other configurations are possible. For example, more modules with more or fewer printheads could be used and with the printheads arranged differently from that shown.

Figure 5:
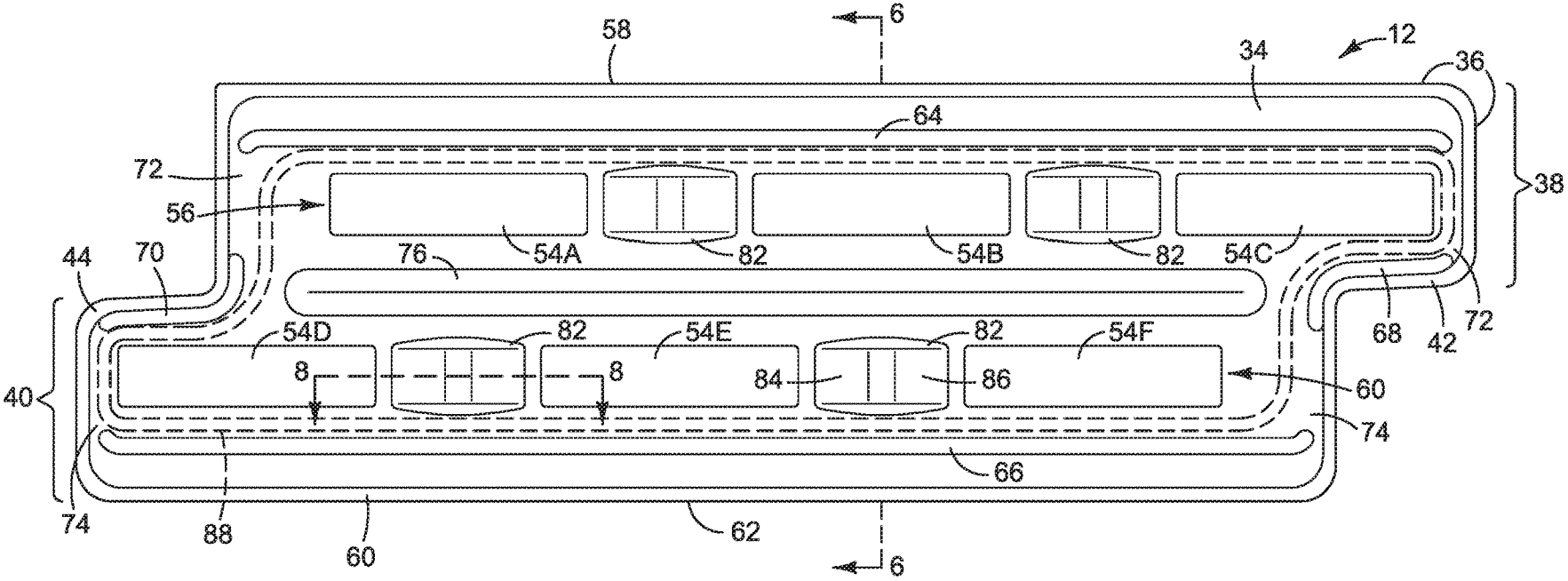
FIG. 5 is a close up view showing the topography of the shroud in the module of FIGS. 3 and 4 in more detail.
Figure 8:
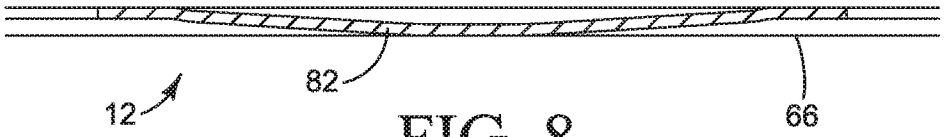
FIG. 8 is a section view along the line 8-8 in FIG. 5.
Figure 6:
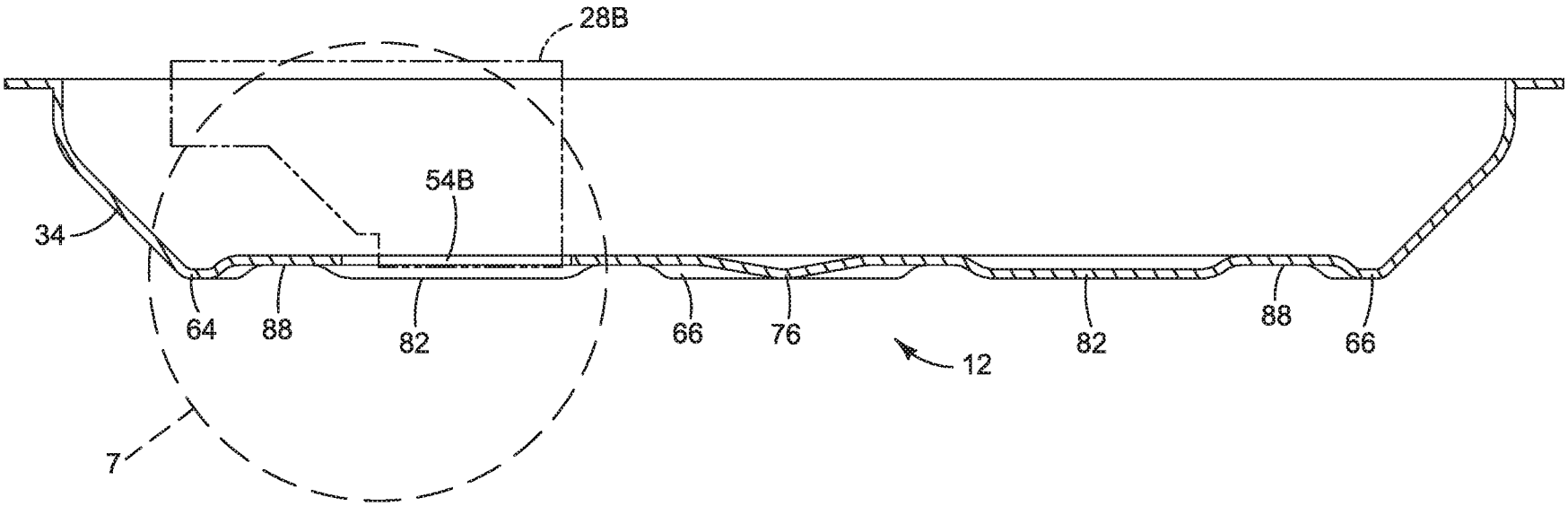
FIG. 6 is a section along the line 6-6 in FIG. 5.
Figure 7:
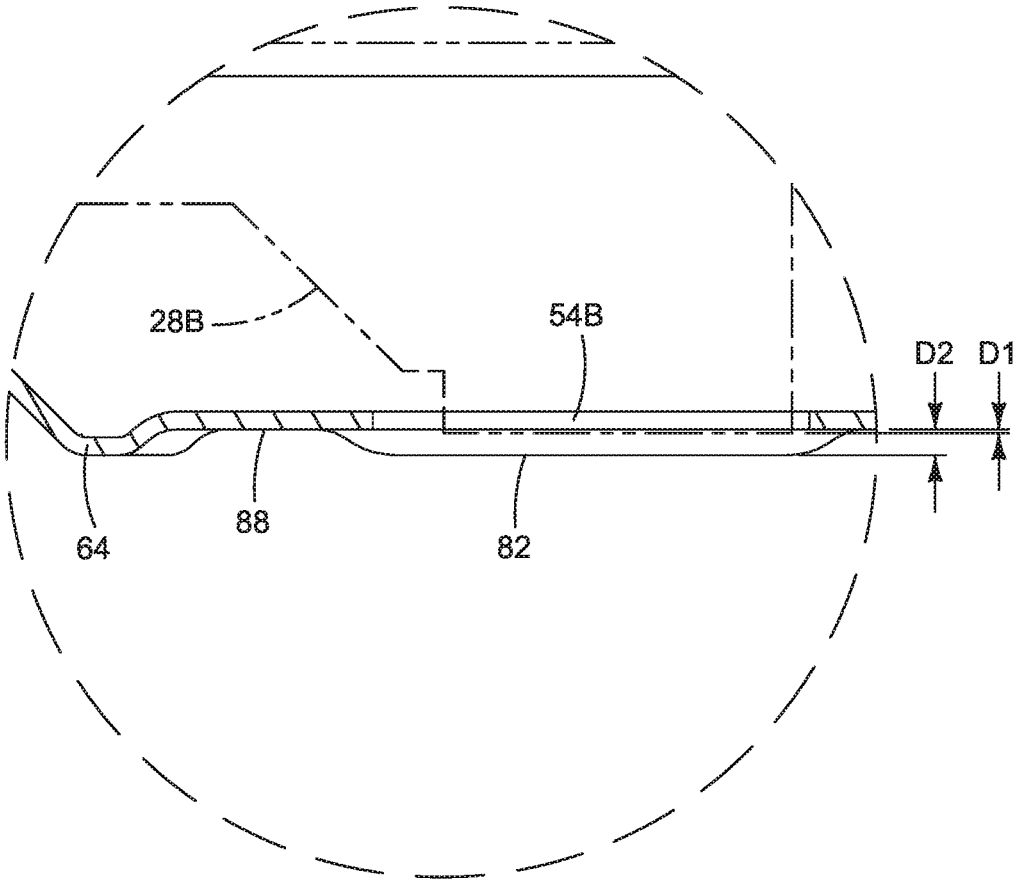
FIG. 7 is a detail view from FIG. 6.

FIG. 5 is a close up view showing the topography of shroud 12 in more detail. FIGS. 6 and 8 are sections from FIG. 5 and FIG. 7 is a detail from FIG. 6. The sections of FIGS. 6 and 8 are re-oriented (flipped over) from the view lines in FIG. 5 to depict the shroud topography protruding downward consistent with the perspectives of FIGS. 3 and 4. Referring to FIGS. 5-8, in the example shown, shroud 12 includes a body 34 having a perimeter 36 that conforms to the perimeter of chassis 30 in a generally stretched S shape characterized by elongated, parallel parts 38, 40 staggered relative to one another with protruding ends 42, 44.

Each printhead 28A-28F is exposed through an opening 54A-54F in shroud body 34 to dispense printing fluid past shroud 12 onto the print media. In the example shown, each opening 54A-54F completely surrounds the exposed part of a corresponding printhead 28A-28F. Also in the example shown, printheads 28A-28F are arranged on printhead assembly module 26 in two rows in a staggered configuration in which the end of each printhead overlaps the end of the adjacent printhead(s). Accordingly, the openings in shroud body 34 are arranged into a first group 56 (openings 54A-54C) aligned across a first, upstream side 58 of body 34 and a second group 60 (openings 54D-54F) aligned across a second, downstream side 62 of body 34 parallel to the openings in first group 56. In this context, "upstream" and "downstream" are taken with respect to the direction print media 16 moves past printhead assembly modules 26, as indicated by direction arrows 19 in FIGS. 1 and 9.

Figure 9:
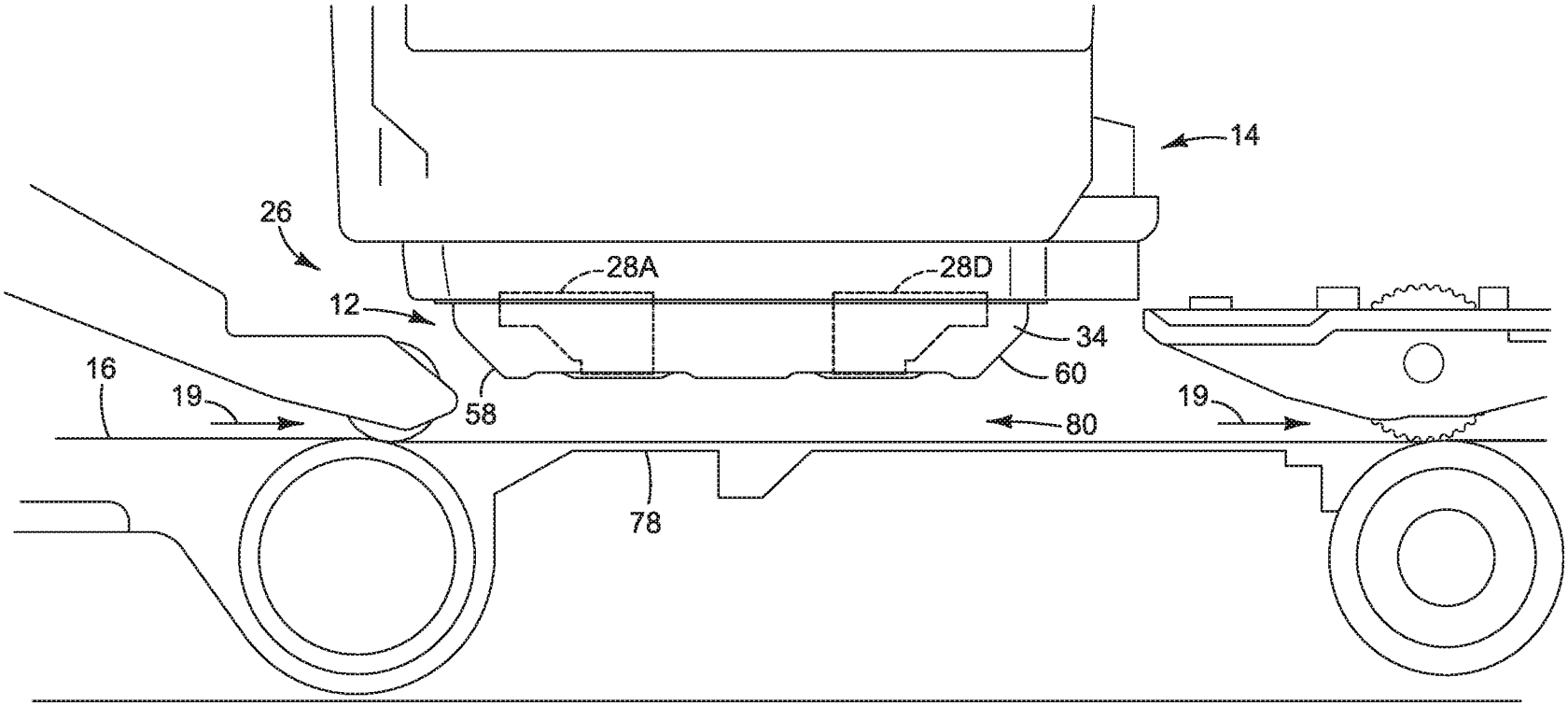
FIG. 9 is a side view illustrating one example print zone in an inkjet printer implementing the printhead assembly shroud shown in FIGS. 2-8.

Continuing to refer to FIGS. 5-8, shroud 12 includes a ridge 64 that extends across body 34 in front of the upstream group 56 of openings 54A-54C to block print media from contacting printheads 28A-28C. In the example shown, shroud 12 includes a ridge 66 that extends across body 34 behind the downstream group 60 of openings 54D-54F, mirroring front ridge 64 so that each shroud 12 (and printhead assembly module 26) is reversible between two orientations, with either side 58 or side 62 facing upstream in the print media direction 19 (FIGS. 1 and 9). Ridges 64 and 66 together complete span all openings 54A-54F and, correspondingly, the exposed part of all printheads 24A-24F when shroud 12 is installed on the printhead assembly.

In the example shown, mirrored ridges 68, 70 snake along each end 42, 44 of shroud body 34. End ridges 68, 70 help protect against print media contacting printheads 28D-28F during printing or inadvertent contact during handling. Also, in the example shown, ridges 68, 70 are discontinuous to provide lanes 72, 74 to facilitate wiping the printheads during servicing operations. Shroud 12 may include a ridge 76 extends across body 34 between each group 56, 60 of openings 54A-54C, 54D-54F parallel to front ridge 64 and rear ridge 66 to help block print media from contacting the exposed part of printheads 28D-28F. Ridge 76 also stiffens shroud body 34 in the otherwise flat interior area of body 34.

Shroud 12 may include ramps 82 protruding from body 34 to help support module 26 and protect the printheads, for example if the module is placed on a surface with the printheads facing down. Each ramp 82 is configured as a two sided ramp positioned between laterally adjacent openings in each group 56, 60. Dual inclines 84, 86 slope in the direction a wiper moves back and forth across the printheads so the wipers do not encounter abrupt bumps during printhead wiping. Each ramp 82 is also sloped in the print media direction, as best seen in the section of FIG. 6, to not present an abrupt edge to any print media that might contact the middle areas of shroud 12 and to facilitate cleaning residue and debris that may accumulate between the protrusions.

Ridges 64-70 and 76 and ramps 82 may be embossed or otherwise formed as an integral part of shroud body 34 or as discrete parts affixed to shroud body 34. Ridges 64 and 66 are spaced apart from openings 54A-54F to allow a substantially flat surface 88 completely surrounding openings 54A-54F. Surface 88 forms a contiguous part of the exterior surface of the shroud body 34 completely surrounding all of the openings 54A-54F inside a perimeter of ridges 64 and 66. A cap is a pressed against surface 88 to seal off the exposed printheads to help keep air from drying out ink in the printhead nozzles during periods of inactivity. While the width of "capping" surface 88 may vary depending on the particular capping device and sealing requirements, it is expected that a capping surface width of at least 0.40 mm will usually be desired for an adequate seal.

As best seen in the detail of FIG. 7, each printhead 28A-28F protrudes from shroud body 34 a distance D1 and each ridge 64-70 and 76 protrudes from shroud body 34 a greater distance D2. A larger D2 (compared to D1) offers better protection for the printheads, however it is usually desirable to have very small printhead-to-media spacing for good print quality. Accordingly, it usually will be desirable to keep D2 as small as possible. While the difference between D2 and D1 may vary, for example depending on the type of print media and the desired printhead-to-media spacing, it is expected that a difference of at least 0.10 mm will be adequate for many large format printing applications.

In FIG. 9, a print bar 14 with a printhead assembly module 26 is positioned over a printer's media support platen 78 defining a print zone 80 in which printing fluid is dispensed on to the paper or other print media 16. Media transport 18 (FIG. 1) includes print zone entry rollers 90, 92 and exit rollers 94, 96. As noted above, ridges 64-70 and 76 (FIGS. 5-8) individually and together block a leading edge of media 16 from crashing into the exposed part of the printheads and help hold print media 16 away from the printheads, for example to block any wrinkles or buckles in media 16 from contacting the printheads.

Figure 10:
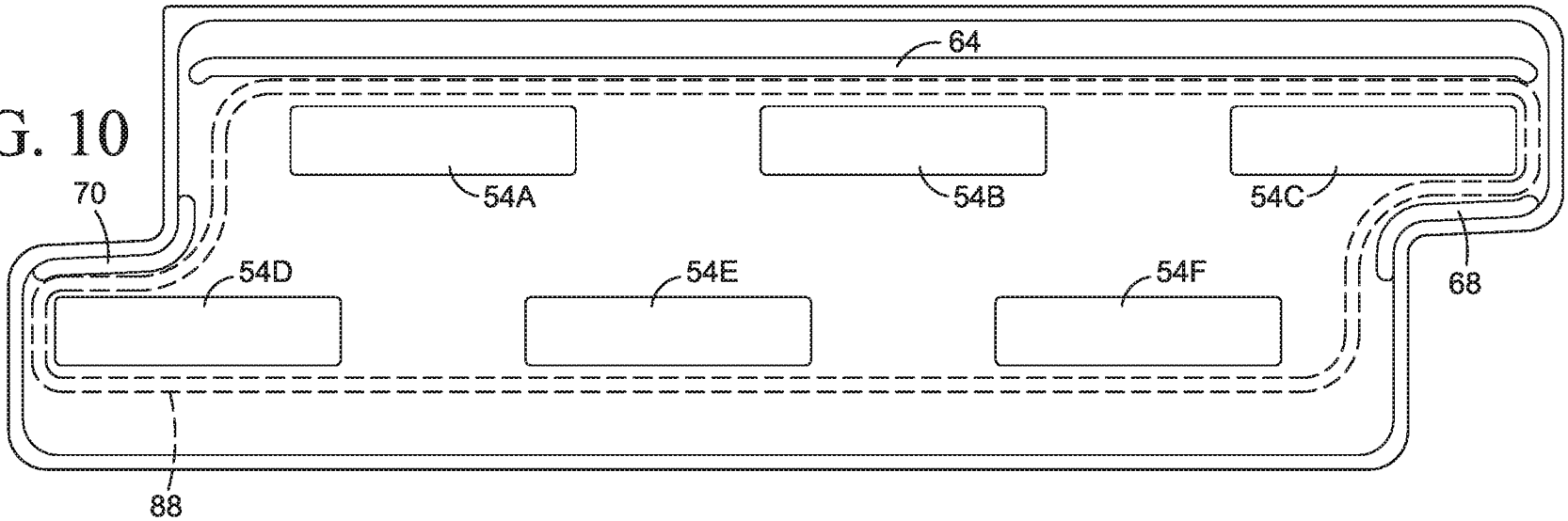
FIGS. 10 and 11 illustrate other examples of a new printhead assembly shroud.
Figure 11:
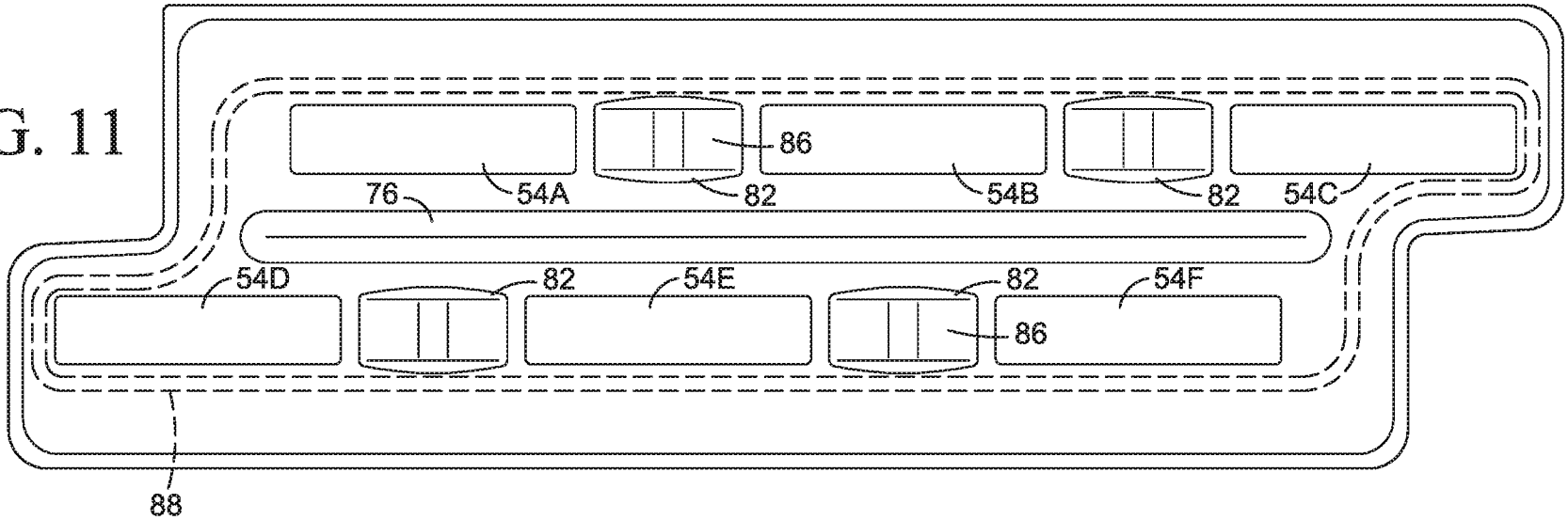

It may not be desirable in all implementations for a shroud 12 to include all of the features shown in FIGS. 2-9. For example, shroud 12 may include only perimeter ridges 64, 68 and 70 as shown in FIG. 10. In another example, shroud 12 may include only a center ridge 76 and ramps 82 as shown in FIG. 11. Other suitable combinations and configurations for the shroud protrusion are possible. Thus, as noted at the beginning of this Description, the examples shown in the figures and described above illustrate but do not limit the invention. Other examples are possible. The foregoing description should not be construed to limit the scope of the invention, which is defined in the following claims.

What is claimed is:

1. A shroud to protect a group of printheads in a printhead assembly, the shroud comprising:

a stretched S shaped body characterized by elongated, parallel first and second sides staggered relative to one another such that one end of each side protrudes past one end of other side;

multiple openings in the body through which the printheads are exposed when the shroud is installed on the printhead assembly, the openings arranged into a first group aligned across the first side of the body and a second group aligned across the second side of the body parallel to the openings in the first group; and a continuous elongated first ridge across an exterior surface of the body next to the openings in the first group, the first ridge upstream from and completely spanning the openings in the first group.

2. The shroud of claim 1, where the openings are arranged in a staggered configuration in which:

an end of each opening in the first group overlaps an end of an opening in the second group; and a last opening in the first group extends into the protruding end of the first side of the body and a last opening in the second group extends into the protruding end of the second side of the body.

3. The shroud of claim 2, comprising a continuous elongated second ridge across the exterior surface of the body next to the openings in the second group, the second ridge downstream from and completely spanning the openings in the second group.

4. The shroud of claim 3, comprising a contiguous part of the exterior surface completely surrounding all of the openings inside a perimeter of the ridges.

5. The shroud of claim 2, comprising a ramp protruding from the exterior surface between laterally adjacent openings, each ramp having two, opposing inclines extending away from one another a direction parallel to a direction a wiper moves across the printheads when the shroud is installed on the printhead assembly.

6. A shroud to protect a group of printheads in a printhead assembly, the shroud comprising:

a body;

a first group of openings aligned across the body and a second group of openings aligned across the body downstream and parallel to the first group of openings, each opening surrounding an exposed part of a printhead when the shroud is installed on the printhead assembly;

a first ridge protruding from and extending across the body upstream from the first group of openings and a second ridge protruding from and extending across the body downstream from the second group of openings; and the first group of openings and the second group of openings symmetrical with one another about an axis and the first ridge and the second ridge symmetrical with one another about the axis such that the shroud is reversible between two orientations to protect the printheads with the first ridge or second ridge upstream from the openings.

7. The shroud of claim 6, comprising a third ridge protruding from and extending across the body between the first group of openings and the second group of openings.

8. The shroud of claim 6, wherein the first ridge includes a single uninterrupted ridge completely spanning the first group of openings and the second ridge includes a single uninterrupted ridge completely spanning the second group of openings.

9. The shroud of claim 6, further comprising a ramp protruding from the body between each pair of laterally adjacent openings, each ramp having two, opposing inclines extending laterally away from one another.

10. A shroud to protect a group of printheads in a printhead assembly, the shroud comprising:

a body having a first notched end where an upstream part of the body extends past a downstream part of the body and a second notched end opposite the first end where a downstream part of the body extends past an upstream part of the body;

a first group of openings in the body aligned across the upstream part of the body and a second group of openings in the body aligned across the downstream part of the body, each opening to surround an exposed part of a printhead when the shroud is installed on the printhead assembly; and a first ridge protruding from and extending across the body upstream from and completely spanning the first group of openings.

11. The shroud of claim 10, where the openings are arranged in a staggered configuration in which:

an end of each opening in the first group overlaps an end of an opening in the second group; and a last opening in the first group extends into the first notched end of the body and a last opening in the second group extends into the second notched end of the body.

12. The shroud of claim 10, comprising a second ridge protruding from and extending across the body downstream from the second group of openings.

13. The shroud of claim 12, comprising a third ridge protruding from and extending across the body between the first group of openings and the second group of openings.

* * * * *